US009291323B2

(12) United States Patent
Yagi et al.

(10) Patent No.: US 9,291,323 B2
(45) Date of Patent: Mar. 22, 2016

(54) VEHICLE LAMP HAVING A NOVEL REFLECTIVE DISTRIBUTION PATTERN

(71) Applicant: KOITO MANUFACTURING CO., LTD., Tokyo (JP)

(72) Inventors: Takayuki Yagi, Shizuoka (JP); Satoshi Yamamura, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 14/611,424

(22) Filed: Feb. 2, 2015

(65) Prior Publication Data

US 2015/0219302 A1 Aug. 6, 2015

(30) Foreign Application Priority Data

Feb. 3, 2014 (JP) ..... 2014-018767

(51) Int. Cl.
*F21S 8/10* (2006.01)
*F21W 101/10* (2006.01)

(52) U.S. Cl.
CPC ..... *F21S 48/1721* (2013.01); *F21S 48/125* (2013.01); *F21S 48/1258* (2013.01); *F21S 48/1388* (2013.01); *F21S 48/145* (2013.01); *F21S 48/1731* (2013.01); *F21S 48/1747* (2013.01); *F21S 48/1757* (2013.01); *F21S 48/1773* (2013.01); *F21S 48/1778* (2013.01); *F21W 2101/10* (2013.01)

(58) Field of Classification Search
CPC ... F21S 48/1721; F21S 48/145; F21S 48/125; F21W 2101/10; G02B 6/0073; G02B 6/0078; G02B 6/0001
See application file for complete search history.

(56) References Cited

U.S. PATENT DOCUMENTS

| | | | | |
|---|---|---|---|---|
| 4,985,816 | A * | 1/1991 | Seko et al. | 362/303 |
| 8,523,417 | B2 * | 9/2013 | Kobayashi | 362/539 |
| 2014/0268837 | A1 * | 9/2014 | Simchak et al. | 362/465 |
| 2014/0285994 | A1 * | 9/2014 | Suzuki | 362/84 |

FOREIGN PATENT DOCUMENTS

JP 9-104288 A 4/1997

* cited by examiner

*Primary Examiner* — Tracie Y Green
(74) *Attorney, Agent, or Firm* — Sughrue Mion, PLLC

(57) ABSTRACT

A vehicle lamp includes a 2D image forming device configured to form a brightness image using light emitted from a light source, an optical projection system configured to project the brightness image forward, and a light blocking member disposed on a path of light emitted from the light source through the 2D image forming device and onward toward the optical projection system, and configured to block at least a portion of the light.

12 Claims, 5 Drawing Sheets

50

VEHICLE LAMP HAVING A NOVEL REFLECTIVE DISTRIBUTION PATTERN

CROSS-REFERENCE TO RELATED APPLICATION

The present application claims priority from Japanese Patent Application No. 2014-018767 filed on Feb. 3, 2014, the entire content of which is incorporated herein by reference.

BACKGROUND OF INVENTION

1. Field of Invention

The present disclosure relates to a vehicle lamp.

2. Related Art

Proposals exist for a vehicle lighting device that forms a desired light distribution pattern by reflecting light emitted from a light source, using a reflection direction converter disposed with plural reflection elements in a matrix formation, and passing the reflected light through a lens (see Patent Document 1). Such a vehicle lighting device can form plural shapes of light distribution pattern by controlling some of multi-arrayed reflection elements so that some of the light emitted from the light source is reflected in a direction other than toward the lens.

PRIOR ART LITERATURE

Patent Document

Patent Document 1: JP-A-9-104288

However, in the vehicle lighting device mentioned above, stray light may occur due to reflection from various components provided in the vehicle lighting device and stray light may occur due to malfunction of the reflection elements, even when the reflective state of some of the reflection elements is controlled such that some of the light emitted from the light source is reflected in a direction other than toward the lens.

SUMMARY OF INVENTION

Exemplary embodiments of the invention provide a vehicle lamp with little glare.

A vehicle lamp according to an exemplary embodiment of the invention comprises:

a 2D image forming device configured to form a brightness image using light emitted from a light source;

an optical projection system configured to project the brightness image forward; and a light blocking member disposed on a path of light emitted from the light source through the 2D image forming device and onward toward the optical projection system, and configured to block at least a portion of the light.

For example, when the 2D image forming device is a transmission type device, even if ideally at least some of the configuration elements are in a state not permitting light transmission forward, sometimes light is transmitted due to insufficient opaqueness of the configuration elements or malfunction of the configuration elements. Moreover, when the 2D image forming device is a reflection type device, even if ideally at least some of the configuration elements are in a state not reflecting light forward, sometimes stray light is generated due to reflection of a cover glass covering the device, or malfunction of the reflection configuration elements. Accordingly light that should not really be transmitted, or reflected stray light, may actually be projected by the optical projection system, resulting in glare to pedestrians and other transport users, such as the vehicle in front.

The above aspect is capable of suppressing glare from occurring due to being able to block light with the light blocking member, even if light is transmitted that should not really be transmitted, or stray light occurs due to reflection.

The light blocking member may include a light blocking region configured to block light emitted from the light source. The light blocking region may be made of a material having a reflectivity of 15% or less. Thereby, glare due to reflected light occurring when light emitted from a light source is blocked in a light blocking region can be suppressed.

The vehicle lamp may further comprise a movement mechanism configured to move the light blocking member. The movement mechanism may be configured to move the light blocking member between a first position when forming a first light distribution pattern, and a second position when forming a second light distribution pattern different from the first light distribution pattern. Thereby, plural light distribution patterns can be realized.

The light blocking member may include a cutline forming portion configured to form a cutline of a low beam light distribution pattern. Thereby, a cutline of a shape not obtainable using the 2D image forming device alone can be formed.

The light blocking member may be disposed on a path of light emitted from the light source toward the 2D image forming device. Light that should not really be transmitted in the 2D image forming device and stray light due to reflection does not accordingly occur due to light blocked by the light blocking member not reaching the 2D image forming device.

The light blocking member may be disposed between the 2D image forming device and the optical projection system. Thus even suppose light that should not really be transmitted in the 2D image forming device or stray light due to reflection occurs, then such light can be prevented from reaching the optical projection system.

Various combinations of relevant configuration elements described above, and changes between expressions of the invention, such as a method, a device, a system, or the like, are also valid embodiments of the invention.

According to the exemplary embodiments of the invention, it is possible to achieve a vehicle lamp with little glare.

DETAILED DESCRIPTION

Figure 1A:
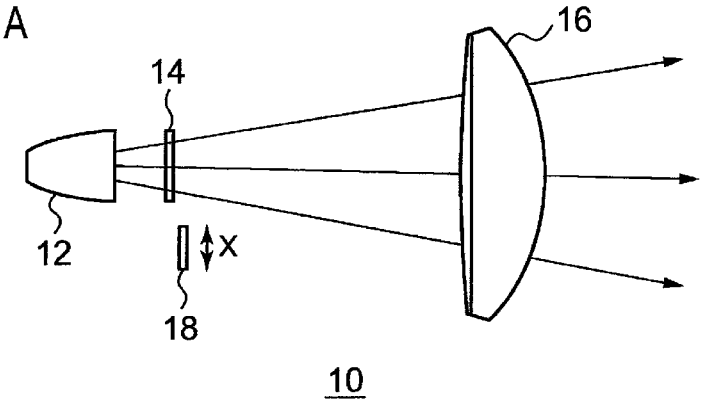
FIG. 1A is a side view schematically illustrating a vehicle lamp according to a first embodiment

Detailed explanation follows regarding embodiments to implement the invention, with reference to the drawings. Similar elements in the drawing explanations are appended with the same reference numerals, and duplicate explanation thereof will be omitted as appropriate.

First Embodiment

Figure 1B:
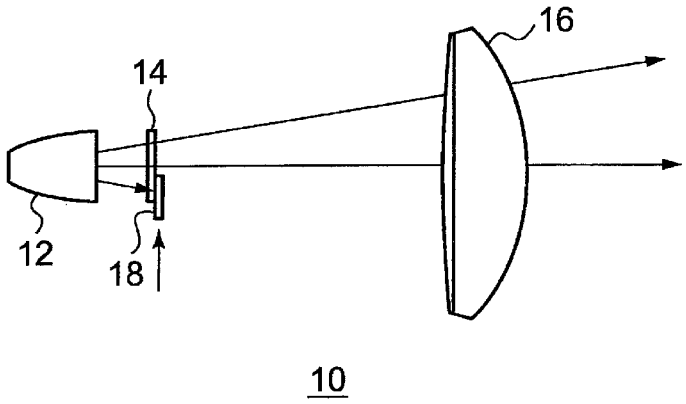
FIG. 1B is a side view illustrating a state in which a light blocking member in the vehicle lamp illustrated in FIG. 1A has moved to a light blocking position.
Figure 1C:
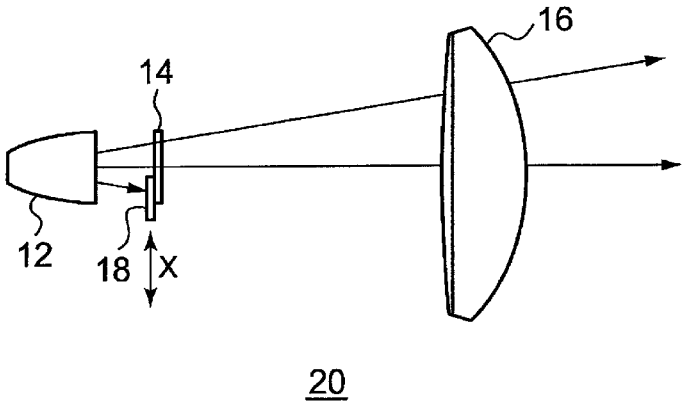
FIG. 1C is a side view schematically illustrating a modified example of a vehicle lamp according to the first embodiment.

FIG. 1A is a side view schematically illustrating a vehicle lamp according to a first embodiment, FIG. 1B is a side view illustrating a state in which a light blocking member in the vehicle lamp illustrated in FIG. 1A has moved to a light blocking position, and FIG. 1C is a side view schematically illustrating a modified example of a vehicle lamp according to the first embodiment.

A vehicle lamp 10 includes a light source 12, a 2D image forming device 14 that forms a brightness image using light emitted from the light source 12, a projection lens 16 serving as an example of an optical projection system that projects the brightness image forward, and a light blocking member 18 that is disposed on the path of light emitted from the light source 12, through the 2D image forming device 14, and onward toward the projection lens 16, and blocks at least some of the light.

Various devices applied to vehicle lamps may be employed for the light source 12. Examples thereof include a light bulb, a discharge lamp, an LED, an LD, and a neon tube. A combination of plural devices may also be employed, according to application and performance demands. Depending on the device, the brightness may also be controlled by lighting on or off some elements, or performing PWM control.

The 2D image forming device 14 is a transmission type device capable of controlling the proportion of light to be transmitted. A liquid crystal panel or the like with elements disposed in a matrix formation is, for example, suitably employed therefor. The projection lens 16 projects light that has passed through the 2D image forming device 14 as a specific light distribution pattern in front of a vehicle. For example, the vehicle lamp 10 illustrated in FIG. 1A forms a high beam light distribution pattern. The light blocking member 18 is movable in the arrow X direction using a non-illustrated movement mechanism.

When the 2D image forming device 14 is a transmission type device, as described above, even if ideally at least some of the liquid crystal elements are in a state not transmitting light forward, sometimes some light is transmitted due to a small amount of light leakage in the liquid crystal elements or malfunction of the liquid crystal elements. The light blocking member 18 is accordingly moved, as illustrated in FIG. 1B, so as to be disposed between the 2D image forming device 14 and the projection lens 16. Thus even if light emitted from the light source 12 reaches a specific region that is controlled so as not to transmit light by the 2D image forming device 14, and then passes through that region, it is reliably blocked by the light blocking member 18. Accordingly, unnecessary transmitted light that should not really be transmitted does not reach the projection lens 16, enabling generation of glare to be suppressed.

Note that, as in the vehicle lamp 20 illustrated in FIG. 1C, a light blocking member 18 may be disposed on the path of light emitted from the light source 12 toward the 2D image forming device 14. Light blocked by the light blocking member 18 consequently does not reach the 2D image forming device 14, such that light that should not really be transmitted through the 2D image forming device 14 does not arise.

Figure 2A:
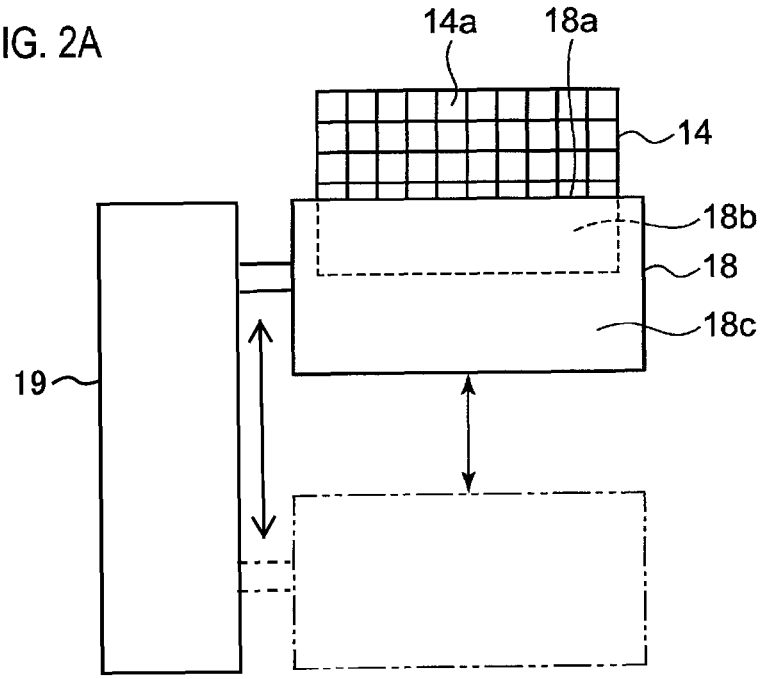
FIG. 2A is a schematic diagram to explain movement of the light blocking member.
Figure 2B:
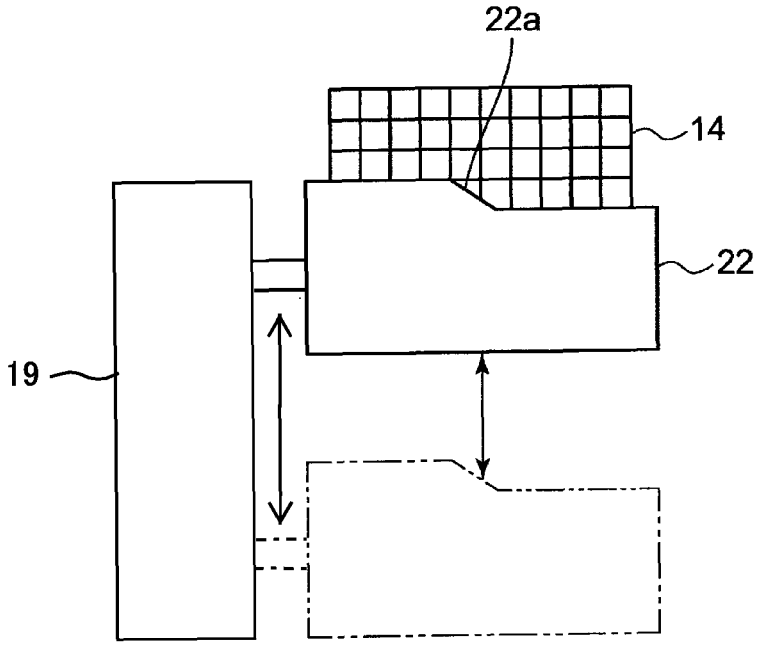
FIG. 2B is a schematic diagram to explain movement of a light blocking member according to a modified example 1.
Figure 3A:
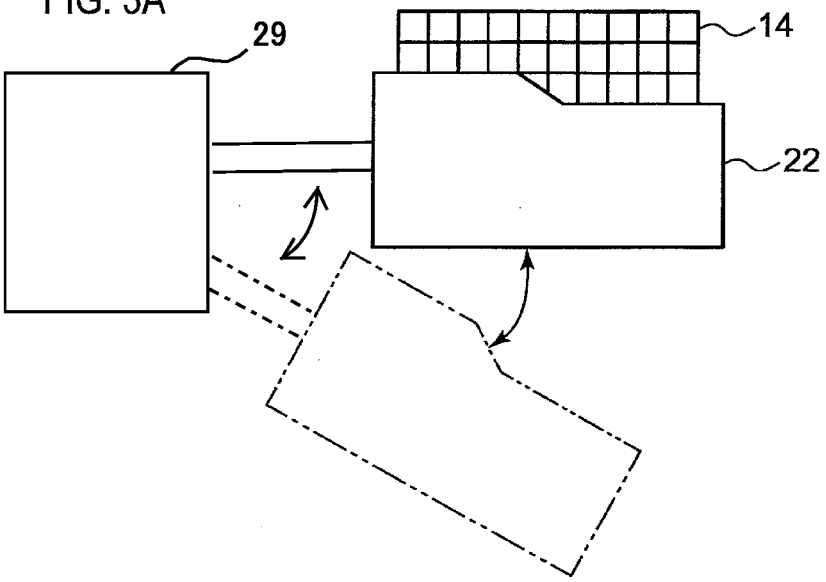
FIG. 3A is a schematic diagram to explain movement of a light blocking member according to a modified example 2.
Figure 3B:
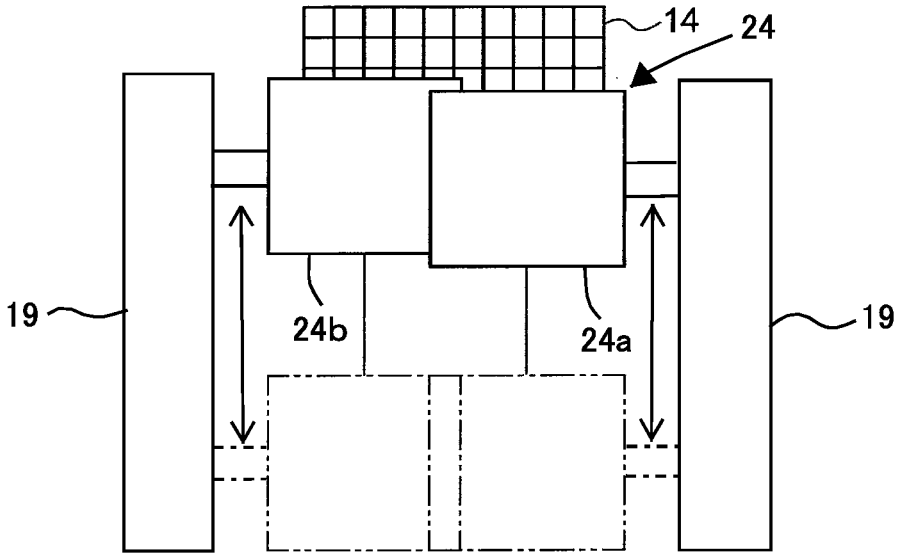
FIG. 3B is a schematic diagram to explain movement of a light blocking member according to a modified example 3.

FIG. 2A is a schematic diagram to explain movement of the light blocking member 18, and FIG. 2B is a schematic diagram to explain movement of a light blocking member according to a modified example 1. FIG. 3A is a schematic diagram to explain movement of a light blocking member according to a modified example 2, and FIG. 3B is a schematic diagram to explain movement of a light blocking member according to a modified example 3.

As illustrated in FIG. 2A, the light blocking member 18 includes a straight line shaped cutline forming portion 18*a* that forms a cutline of a specific light distribution pattern. The light blocking member 18 is capable of forming a cutline by moving the cutline forming portion 18*a* with a movement mechanism 19 to a position that is not on a boundary line between respective configuration elements 14*a* of the 2D image forming device 14. This cutline cannot be obtained by controlling each of the configuration elements of the 2D image forming device 14.

The light blocking member 18 includes a light blocking region 18*b* blocking light emitted from the light source 12 that has been transmitted through the 2D image forming device 14. The surface of the light blocking region 18*b* may be made of a material having a reflectivity of 15% or less to light from the light source. Generation of glare from reflected light can thereby be suppressed when using the light blocking region to block light emitted from the light source 12 that has passed through the 2D image forming device 14.

A light blocking member 22 illustrated in FIG. 2B includes the feature of an angled (polygonal) cutline forming portion 22*a* for a low beam light distribution pattern (light distribution pattern to pass oncoming vehicles). This thereby enables glare to oncoming vehicles to be suppressed whilst enhancing visibility in the lane of the vehicle itself. Considering the lamp space, the light blocking member 22 may also be made to advance or retract using a rotation mechanism 29, as illustrated in FIG. 3A.

A light blocking member 24 illustrated in FIG. 3B includes two members 24*a*, 24*b*. The two members 24*a*, 24*b* are configured to be independently movable. This thereby enables various light distribution patterns. Moreover, such a vehicle lamp is applicable to both right hand drive and left hand drive regions without special design change.

The shape at the ends of each of the light blocking members described above may also be a curved shape in consideration of the field curvature of an optical projection system.

Second Embodiment

Figure 4A:
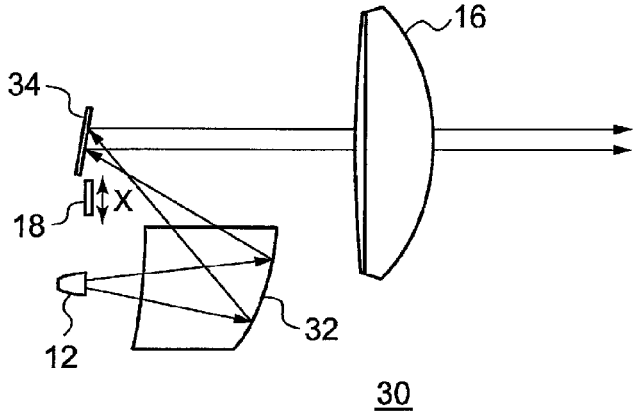
FIG. 4A is a side view schematically illustrating a vehicle lamp according to a second embodiment.
Figure 4B:
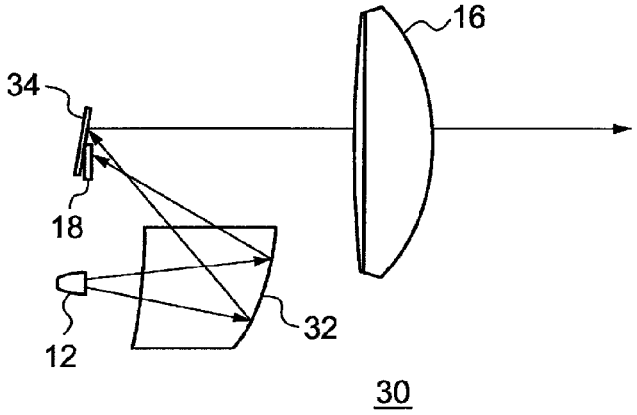
FIG. 4B is a side view illustrating a state in which a light blocking member of the vehicle lamp illustrated in FIG. 4A has been moved to a light blocking position.
Figure 4C:
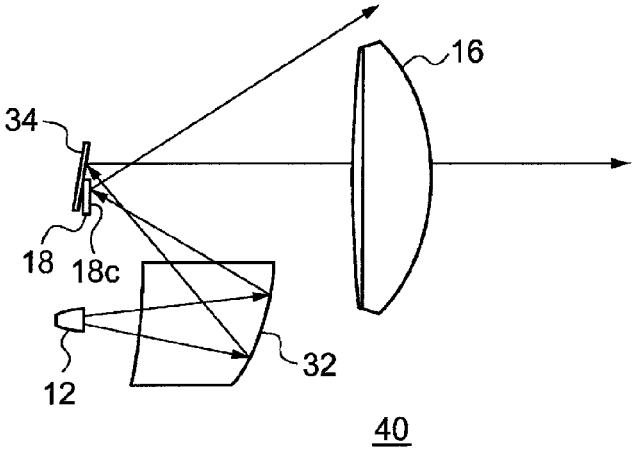
FIG. 4C is a side view schematically illustrating a modified example of a vehicle lamp according to the second embodiment.

FIG. 4A is a side view schematically illustrating a vehicle lamp according to a second embodiment, FIG. 4B is a side view illustrating a state in which a light blocking member of the vehicle lamp illustrated in FIG. 4A has been moved to a light blocking position, and FIG. 4C is a side view schematically illustrating a modified example of a vehicle lamp according to the second embodiment.

A vehicle lamp 30 includes a light source 12, a reflector 32 that reflects light so as to concentrate light emitted from the light source 12, a 2D image forming device 34 that forms a brightness image with the light reflected by the reflector 32, a projection lens 16 that projects the brightness image forward, and a light blocking member 18 disposed on the path of light emitted from the light source 12, through the 2D image forming device 34, and onward toward the projection lens 16, and blocks at least some of the light.

The 2D image forming device 34 is a reflection type device that is capable of controlling a direction in which light is reflected. Examples of devices suitably employed therefor include a reflection type liquid crystal panel disposed with liquid crystal elements in a matrix formation, and a micro electro mechanical system (MEMS) with micro minors disposed in a matrix formation. A reflection face of the 2D image forming device 34 is sometimes provided with a transparent cover to protect the liquid crystals or micro mirrors from the external environment. The projection lens 16 projects a specific light distribution pattern of light that has been reflected by the 2D image forming device 34 in front of a vehicle. For example, the vehicle lamp 30 illustrated in FIG. 4A forms a high beam light distribution pattern.

When the 2D image forming device 34 is a reflection type device, as described above, even if ideally at least some of the liquid crystal elements or micro mirrors are in a state not reflecting light forward toward the projection lens, sometimes some stray light is generated due to reflection of a transparent cover covering the device or malfunction of the liquid crystal- or micro mirror-configuration elements. The light blocking member 18 is accordingly moved, as illustrated in FIG. 4B, so as to be disposed between the 2D image forming device 34 and the projection lens 16. Thus light emitted from the light source 12 is blocked from reaching a part region of the 2D image forming device 34. Thus even if stray light occurs due to malfunction of the elements or the like, such stray light is blocked by the light blocking member 18, enabling generation of glare caused by stray light to be suppressed.

A reflection face 18*c* (see FIG. 2A) may also be configured on the face of the light blocking member 18 on reflector 32 side, as in a vehicle lamp 40 illustrated in FIG. 4C. The reflection face 18*c* is configured such that when blocking the light reflected at the reflector 32, light reflected by the reflection face 18*c* is not incident to the projection lens 16. The light blocked by the light blocking member 18 accordingly does not reach the 2D image forming device 34, and the light reflected by the reflection face 18*c* of the light blocking member 18 is not incident to the projection lens 16.

Figure 5:
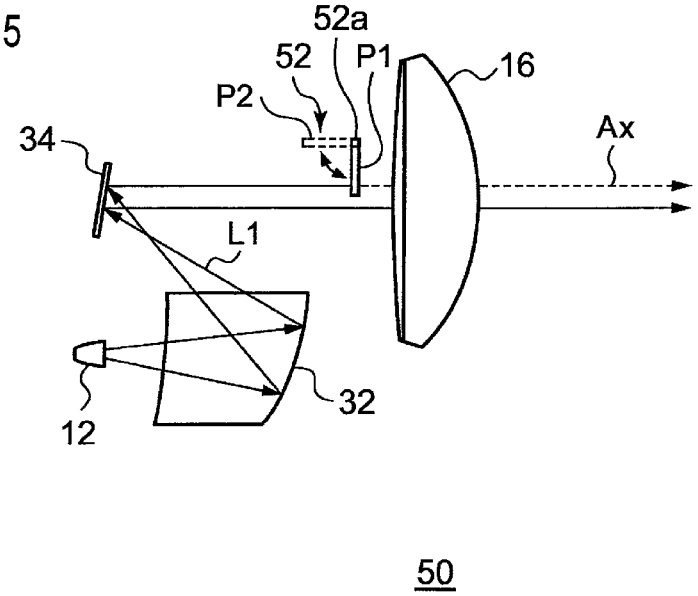
FIG. 5 is a side view schematically illustrating another modified example of a vehicle lamp according to the second embodiment.

FIG. 5 is a side view schematically illustrating another modified example of a vehicle lamp according to the second embodiment. A vehicle lamp 50 illustrated in FIG. 5 includes a light blocking member 52 in a different position to in the vehicle lamp 30. More specifically, as illustrated in FIG. 5, the light blocking member 52 may be disposed on the opposite side of an optical axis Ax of the optical projection system to a light ray L1 incident to the 2D image forming device 34. The light blocking member 52 may be disposed at a position near to the optical projection system (the projection lens 16), so as not to interfere with the light ray L1 incident to the 2D image forming device 34. The light blocking member 52 is a plate shaped member that is swung about a support point 52*a* by a non-illustrated movement mechanism, between a blocking position P1 and an open position P2. The light blocking member 52 may be configured so as to slide in the up-down direction, similarly to the light blocking member 18.

Each of the above vehicle lamps equipped with the respective light blocking sections and 2D image forming devices is particularly favorably applied to a fog lamp or a low beam headlamp. This is because it is difficult to completely avoid unnecessary reflected light and leaking light in lamps that do not have a light blocking section, and only include a 2D image forming device, and it is accordingly difficult to satisfy the required value for contrast between illumination portions and non-illumination portions of light distribution patterns for use in fog and low beam lamps.

Each of the above vehicle lamps is, for example, a configuration suitable for use as a low beam lamp or a fog lamp with an adaptive driving beam (ADB) using a MEMS mirror array.

The invention has been described in detail and by reference to the respective embodiments and its modified examples; however, the invention is not limited to them and includes various combination or substitution of structures of the respective embodiments. Further, based on the knowledge of the person skilled in the art, it is possible to change the orders of combination or processes in each of the embodiments, or to add the modification such as design change and the like to each of the embodiments. The embodiments to which such modifications are added can be included in the scope of the invention.

What is claimed is:

1. A vehicle lamp comprising:

a 2D image forming device configured to form a brightness image using light emitted from a light source;

an optical projection system configured to project the brightness image forward; and a light blocking member disposed on a path of light emitted from the light source through the 2D image forming device and onward toward the optical projection system, and configured to block at least a portion of the light, wherein the 2D image forming device and light blocking member are separate members.

2. The vehicle lamp of claim 1, wherein:

the light blocking member includes a light blocking region configured to block light emitted from the light source, and the light blocking region is made of a material having a reflectivity of 15% or less.

3. The vehicle lamp of claim 1, further comprising:

a movement mechanism configured to move the light blocking member, wherein: the movement mechanism is configured to move the light blocking member between a first position when forming a first light distribution pattern, and a second position when forming a second light distribution pattern different from the first light distribution pattern.

4. The vehicle lamp of claim 1, wherein the light blocking member includes a cutline forming portion configured to form a cutline of a low beam light distribution pattern.

5. The vehicle lamp of claim 1, wherein the light blocking member is disposed on a path of light emitted from the light source toward the 2D image forming device.

6. The vehicle lamp of claim 1, wherein the light blocking member is disposed between the 2D image forming device and the optical projection system.

7. The vehicle lamp of claim 1, wherein the 2D image forming device comprises a transmission type liquid crystal panel configured to control a proportion of the light emitted from the light source to be transmitted through the liquid crystal panel.

8. The vehicle lamp of claim 1, wherein the 2D image forming device comprises a reflection type 2D image forming device.

9. The vehicle lamp of claim 8, wherein the reflection type 2D image forming device comprises a reflection type liquid crystal panel or a micro electro mechanical system (MEMS).

10. The vehicle lamp of claim 1, further comprising:

a movement mechanism configured to move the light blocking member, wherein: the movement mechanism is configured to move the light blocking member linearly between a first position and a second position different from the first position.

11. The vehicle lamp of claim 10, wherein the movement mechanism is configured to move the light blocking member between the first position when forming a first light distribution pattern, and the second position when forming a second light distribution pattern different from the first light distribution pattern.

12. The vehicle lamp of claim 1, wherein the light blocking member comprises a plurality of light blocking members.

* * * * *